US010603697B2

(12) United States Patent
Fickert

(10) Patent No.: US 10,603,697 B2
(45) Date of Patent: Mar. 31, 2020

(54) METHOD AND SYSTEM FOR TREATING KEGS

(71) Applicant: KHS GmbH, Dortmund (DE)

(72) Inventor: Hilmar Fickert, Kriftel (DE)

(73) Assignee: KHS GmbH, Dortmund (DE)

( * ) Notice: Subject to any disclaimer, the term of this patent is extended or adjusted under 35 U.S.C. 154(b) by 545 days.

(21) Appl. No.: 14/760,287

(22) PCT Filed: Jan. 13, 2014

(86) PCT No.: PCT/EP2014/000055

§ 371 (c)(1),
(2) Date: Jul. 10, 2015

(87) PCT Pub. No.: WO2014/111244

PCT Pub. Date: Jul. 24, 2014

(65) Prior Publication Data

US 2015/0352607 A1 Dec. 10, 2015

(30) Foreign Application Priority Data

Jan. 15, 2013 (DE) ..... 10 2013 000 522

(51) Int. Cl.
*B08B 9/08* (2006.01)

(52) U.S. Cl.
CPC ..... *B08B 9/0804* (2013.01); *B08B 9/0813* (2013.01); *B08B 2203/007* (2013.01)

(58) Field of Classification Search
CPC ..... B08B 9/0804; B08B 9/0813; B08B 2203/007
See application file for complete search history.

(56) References Cited

U.S. PATENT DOCUMENTS 8,858,722 B2 * 10/2014 Cull ..... F25B 45/00 134/22.18
2002/0162649 A1 * 11/2002 Fineblum ..... F28D 7/106 165/154
2015/0352607 A1 * 12/2015 Fickert ..... B08B 9/0813 134/22.18

FOREIGN PATENT DOCUMENTS

DE 36 28 165 2/1988
DE 196 25 184 1/1998
DE 10 2008 018105 11/2009

* cited by examiner

*Primary Examiner* — Sharidan Carrillo
(74) *Attorney, Agent, or Firm* — Occhiuti & Rohlicek LLP

(57) ABSTRACT

An apparatus for treating a keg's interior comprises first and second tanks that maintain treatment medium at respective first and second temperatures, a first heat-exchanger, and a waste-air line. The first heat-exchanger is arranged upstream of a second-tank inlet for using heat recovered from the treatment medium through heat exchange with a heat-transfer medium to pre-heat treatment medium that is being conducted to the second tank. The heat-transfer medium includes any one or more of treatment medium conducted out of a keg interior after a treatment step, treatment medium in the first tank, and waste air in the waste-air line.

8 Claims, 3 Drawing Sheets

METHOD AND SYSTEM FOR TREATING KEGS

RELATED APPLICATIONS

This application is the U.S. national stage under 35 USC 371 of international application PCT/EP2014/000055, filed on Jan. 13, 2014, which claims the benefit of the Jan. 15, 2013 priority date of German application DE 102013000522.1, the contents of which are herein incorporated by reference.

FIELD OF INVENTION

The invention methods and systems for treatment of kegs, and in particular, managing energy usage during keg treatment.

BACKGROUND

It is known to subject kegs that have been returned to beverage manufacturers, such as to breweries, to exterior and interior cleaning procedures that include treatment steps. Known methods include cleaning a keg's interior with different treatment media heated to different treatment temperatures. For example, one method begins with a preliminary treatment with mixed water still containing beverage residues at a treatment temperature of between 50° C. and 70° C. This is followed with alkali and acid at a treatment temperature of between 60° C. and 80° C. Finally, there is a treatment with fresh or hot water at a temperature of some 85° C. Providing different treatment media at different temperatures consumes a great deal of energy.

SUMMARY

The invention makes provision of the fact that, at least on carrying out the first treatment step i.e. the step of pre-cleaning the respective keg interior with the first treatment medium, for example mixed water, the treatment medium (e.g. hot water) used in a subsequent treatment step is exclusively used, preferably the medium used in the final step of cleaning, to clean the interior of the keg and/or that, for heating the second treatment medium for carrying out the subsequent treatment step, for example, the fresh water, the heat energy is derived from the treatment medium used in the first treatment step and/or that the heat energy of the waste air incurred in the system and containing vapor and this is used.

Preferably, the heat recovery takes place by the pre-heating of the second treatment medium in several steps by means of a plurality of heat exchangers arranged in a feed line of this medium, i.e. in a first heat exchanger by utilization of the heat energy of the treatment medium (e.g. mixed water) conducted off after the first treatment step, in a second heat exchanger by utilization of the heat energy of the first treatment medium, and/or of the treatment medium (e.g. hot water) conducted off after the further treatment step, and in a third heat exchanger by utilization of the heat energy of the waste air, wherein the heat exchangers are preferably arranged following one another in the sequence indicated above in the feed line of the hot water tank.

The first heat exchanger in this situation is preferably a cyclone heat exchanger. In order to exploit as much energy as possible from the treatment medium (e.g. waste water) deriving from the first treatment step in order to heat the fresh water, this treatment medium is retained, by means of a suitable regulating and/or control system, in the cyclone heat exchanger or in the cyclone chamber of this heat exchanger sufficiently long for the whole of the economically viable quantity of heat to have been extracted from the treatment medium, or, respectively, until the derived treatment medium has reached a minimum temperature which is still somewhat above the temperature of the second fresh treatment medium (e.g. fresh water) which is being fed in, and which lies, for example, in the range between 15° C. and 20° C.

Provided in the discharge line of the primary side of the cyclone heat exchanger or, respectively, of the cyclone chamber of this heat exchanger is a valve, preferably temperature-controlled, which then opens when the temperature of the medium being conducted on the primary side falls below a specified threshold value. As a result of this it is then possible, for the complete emptying of the respective kegs, for the essentially colder product or filling residue to be conducted away directly by way of the cyclone heat exchanger.

The term cyclone or cyclone chamber is to be understood, in the meaning of the invention, to be essentially a container in which vapors and/or mists separate from a liquid phase, wherein vapor and/or mists are conducted away as waste air by way of a waste air channel to the surroundings outside a production hall, and specifically, among other considerations, also with the advantage of a reduction in the burden imposed on personnel by the waste air and avoidance of the ingress of moisture into a production hall. The container which forms the cyclone or cyclone chamber is, for example, double-walled for its heat exchanger function with at least one flow channel formed in the container wall, through which the second treatment medium (e.g. fresh water) flows.

With the second heat exchanger, which is allocated to a first tank of the first treatment medium, by means of heat transfer to the second treatment medium (e.g. fresh water) which is flowing through this heat exchanger on the secondary side, there takes place simultaneously a cooling of the first treatment medium, which is being conducted to the first tank from a further treatment step (e.g. hot water flushing). As a result, it is possible for the first treatment medium to be adjusted to a first temperature, for example a temperature of 60° C., which lies perceptibly below the temperature of the treatment medium being conducted back from the further treatment step (e.g. hot water flushing). It is therefore possible to do without the introduction of additional fresh water into the tank of the first treatment medium. In addition to this, due to the reduced temperature of the first treatment medium (e.g. mixed water), the precipitation of protein in the first treatment step of the keg internal cleaning is also avoided, which would otherwise render the entire cleaning process more difficult, in particular in the case of kegs filled with wheat yeast.

In the heat exchanger arranged in the waste air channel, condensation takes place of the mists and vapor in the waste air, as a result of which not only is the condensation heat thereby incurred exploited for the pre-heating of the fresh water, but also, as a further substantial advantage, a reduction of the burden of mists and/or vapor on the environment is also achieved. The final heating of the second treatment medium (e.g. fresh water) to the second temperature takes place, for example in a heating device formed from a vapor-driven heat exchanger. In addition, by means of this heating device or a further heating device, the temperature of the second treatment medium is maintained. By means of appropriate controlling of the fresh second treatment medium being introduced, and/or of the heating devices, fluctuations within the production sequence can be compensated for without any problem.

By way of the invention, the energy requirement for the heating of the second treatment medium (e.g. fresh water) to the required temperature can be reduced in comparison with methods or systems with which the heating takes place without heat recovery, by 40%-50%.

The expression "essentially" or "some" in the meaning of the invention signifies deviations from the respective exact value by +/−10%, preferably by +/−5% and/or deviations in the form of changes which are of no significance for the function.

Further embodiments, advantages, and application possibilities of the invention are also derived from the following description of embodiments and from the figures. In this context, all the features described and/or represented as images are, individually or in any desired combination, basically the object of the invention, regardless of their combination in the claims or other reference to them. The contents of the claims are likewise made a constituent part of the description.

BRIEF DESCRIPTION OF THE DRAWINGS

These and other features of the invention will be apparent from the following detailed description and the accompanying figures, in which.

DETAILED DESCRIPTION

Figure 1:
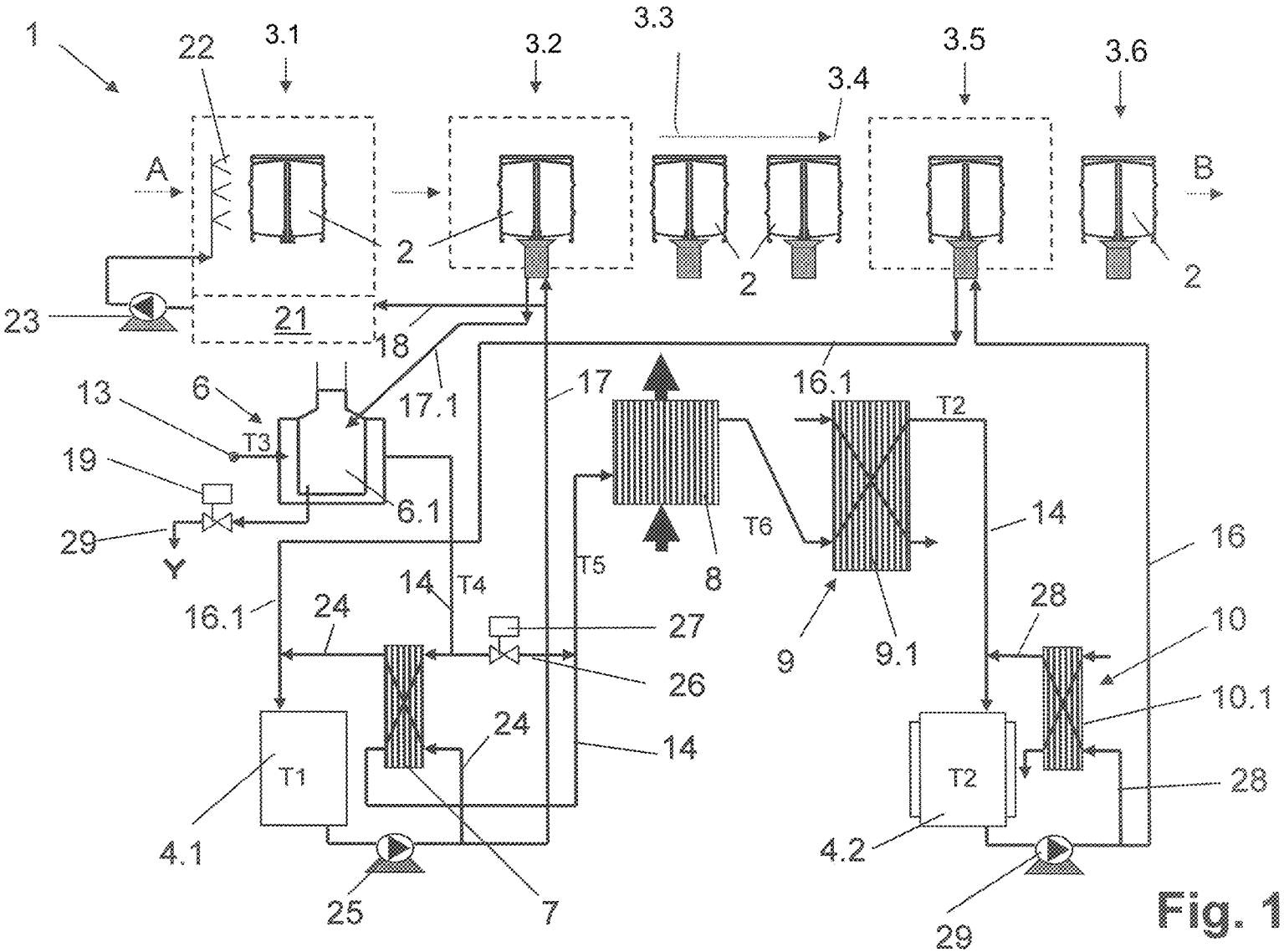
FIG. 1 in a schematic function representation, a system for the treatment of kegs, i.e. for the cleaning and filling of kegs, together with function elements for the provision of the different liquid treatment media used in the treatment, and with elements for heat recovery.

The system designated in general in the figures by 1 serves to clean kegs 2, as well as to fill or refill the cleaned kegs 2 with a liquid filling product, such as a beverage, e.g. beer. The cleaning and filling of the kegs 2 takes place with the kegs 2 in an inverted state, i.e. with the respective keg fitting pointing downwards, and in a plurality of treatment steps, for example at a plurality of treatment positions, which are designated in FIG. 1 by 3.1-3.6. The kegs 2 are conducted into the system 1 in accordance with the arrow A to a keg inlet. The cleaned and refilled kegs are taken by the system 1 in accordance with the arrow B to a keg outlet.

At the treatment position 3.1, an external cleaning of the kegs 2 takes place, at the treatment positions 3.2-3.5 an internal cleaning of the kegs 2, and at the treatment position 3.6 the filling of the cleaned kegs 2. In detail, at the treatment position 3.2, first an emptying of filling product residue of the kegs 2 takes place, and then a treatment or pre-cleaning respectively of the respective keg interior with a treatment medium in the form of mixed water, heated to a first temperature T1, in the treatment positions 3.3 and 3.4 a treatment or cleaning respectively of the respective keg interior with heated alkali and acid, and at the treatment position 3.5 a treatment or, respectively, a final flushing of the respective keg interior with hot fresh water or hot water at a temperature T2, for example at a temperature of 85° C. or essentially of 85° C. The temperature T1 is in this situation selected in such a way that the precipitation of protein during the pre-cleaning in the treatment step 3.2 does not occur, i.e. the temperature T1 lies below 70° C. and amounts, for example, to 60° C. or essentially 60° C. The mixed water at the temperature T1 is provided from a medium or mixed water tank 4.1, and the hot water at the temperature T2 is provided from a medium or hot water tank 4.2.

In order to heat the treatment media and to reduce the energy requirement by heat recovery, the following function elements are also allocated to the treatment positions:

A first heat exchanger 6, which in the embodiment represented is designed as a double-walled cyclone-heat exchanger, a second heat exchanger 7, which in the embodiment represented is designed, for example, as a tank-integrated nest of tubes, a third heat exchanger 8, which in the embodiment represented is designed, for example, as a plate heat exchanger, and heaters or heating devices 9 and 10, which in the embodiment represented are designed in each case as heat exchangers 9.1 and 10.1 respectively, and on the primary side are flowed through by a hot heating medium, for example water vapor.

In addition to the mixed water tank 4.1 and the hot water tank 4.2, the system also includes further media tanks 5.1-5.3 for alkali (alkali 1 and alkali 2) as well as for acid. In order also to exploit the heat energy of the waste air and the mists and vapor from the system 1, and in this situation in particular from the mixed water tank 4.1, from the hot water tank 4.2, from the media tank 5.1-5.3, and from the treatment position 3.1, the gas chambers of these tanks, of the heat exchangers 6, and also of the interior of treatment position 3.1, are connected to a waste air line 12, equipped with a fan or ventilator 11, in which the primary side of the heat exchanger 8 is arranged, and, specifically in the embodiment represented, in the flow direction of the waste air downstream of the ventilator 11 and upstream of an opening 12.1 in the waste air line 12, arranged outside a system building, for example on the building roof.

Figure 2:
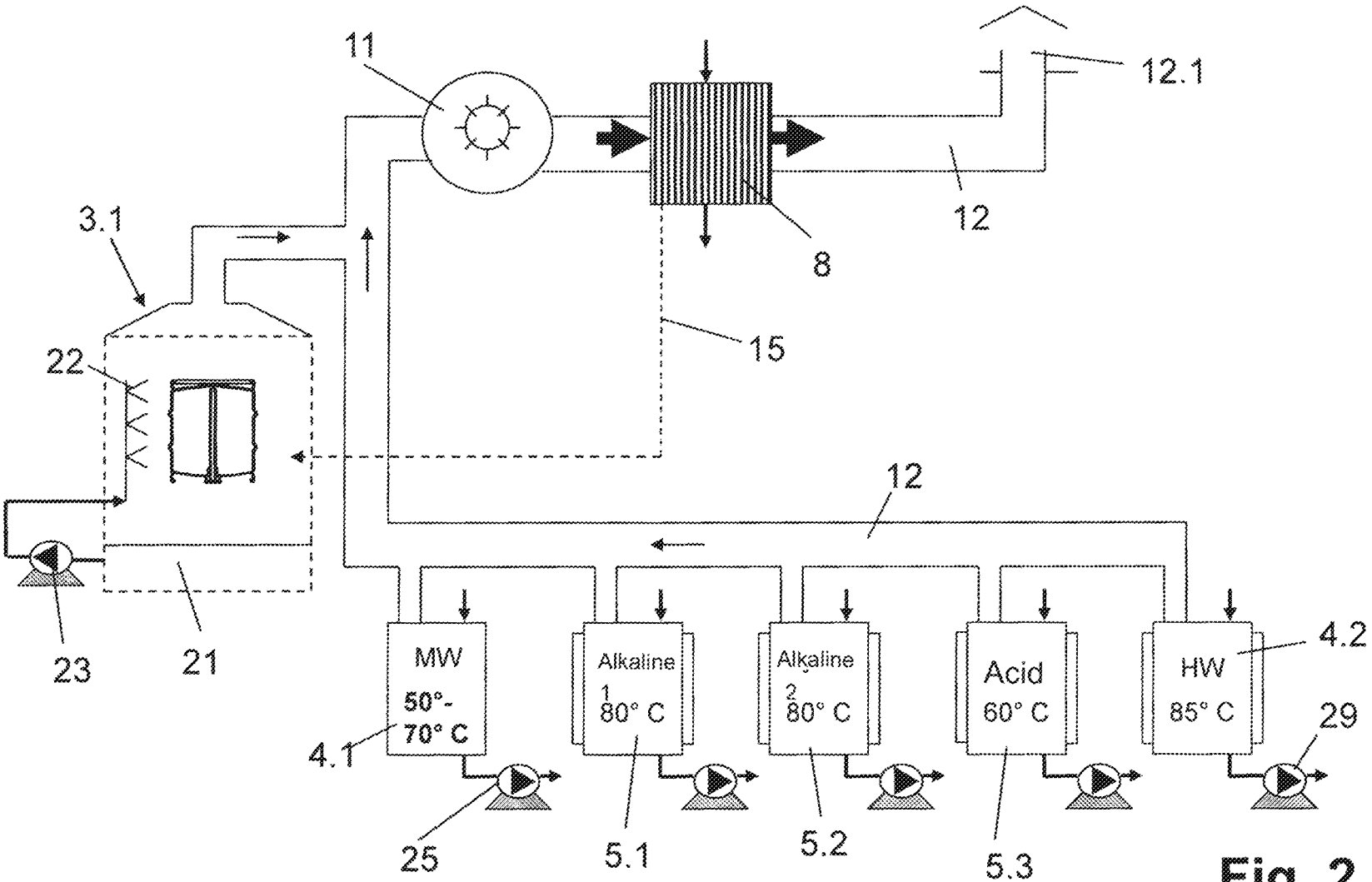
FIG. 2 in a schematic function representation, a waste air system for the system from FIG. 1 for the recovery of the heat energy from waste air, together with reservoirs or media tanks for different treatment media.
Figure 3:
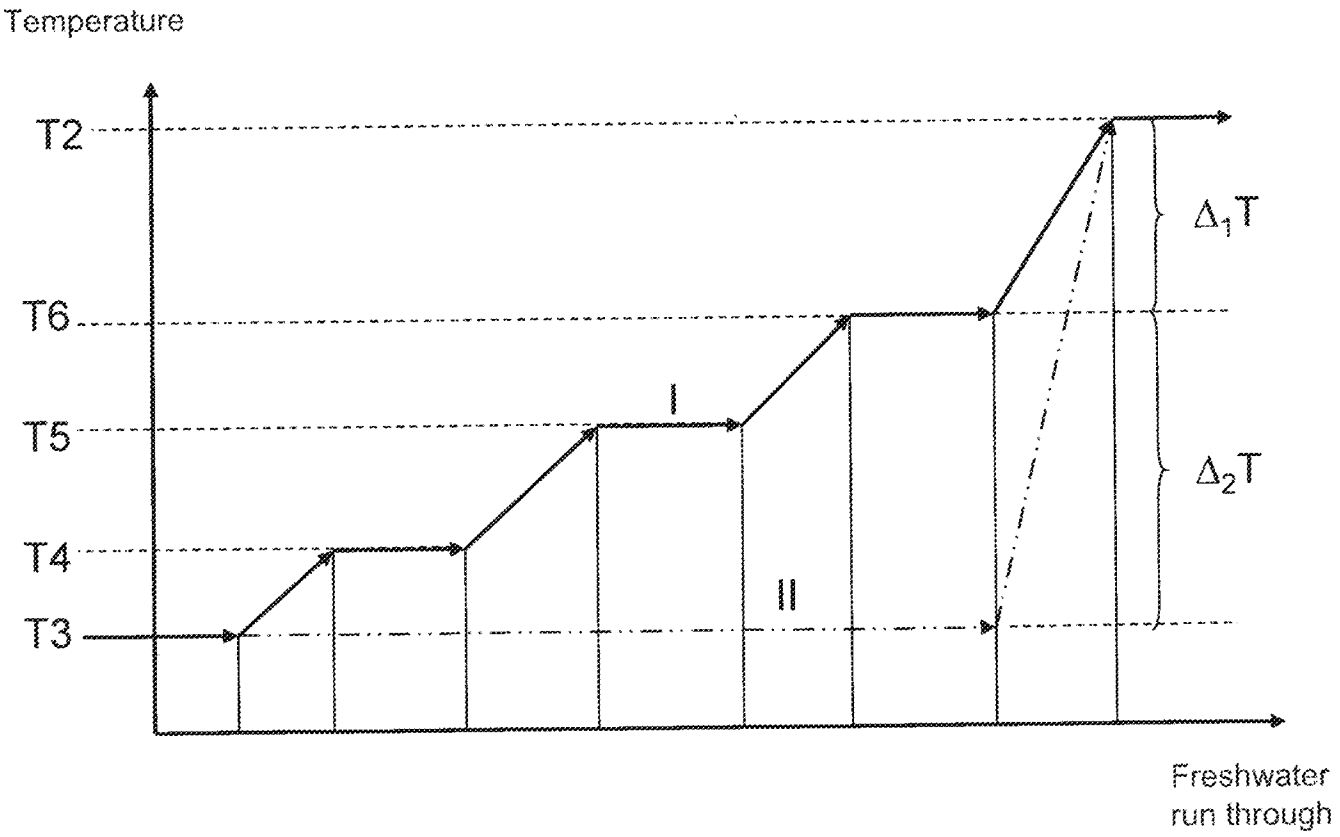
FIG. 3 in a diagram, the temperature curve during the heating of the treatment medium formed from hot water with the system from FIG. 1.

The basic function of the heat recovery with the system 1 can be described in detail in that the fresh water required for the interior flushing of the kegs at the treatment position 3.5 is conducted to the system 1 by way of the connection 13 at a temperature T3, for example at a temperature in the range between 5° C. to 15° C., heated in a feed line from the hot water tank 4.2, i.e. in a pipe connection 14 between the connection 13 and the hot water tank 4.2 in a plurality of steps, and, specifically, first by heat recovery in the heat exchanger 6, by mean of the heated return water (mixed water) conducted from the treatment position 3.2 from the respective keg interior, to a temperature T4, then in the heat exchanger 7 by the mixed water from the mixed water tank 4.1 to a temperature T5, and then in the heat exchanger 8 by the waste air in the waste air line 12 to a temperature T6 (FIG. 3). The condensate precipitated in the heat exchanger 8 from the waste air is conducted as return water to the treatment position 3.1, as indicated by the broken line 15 in FIG. 2. The fresh water, heated in this way to the temperature T6 solely by heat recovery, is then heated in the heating device 9 to the temperature T2, and in this state is conducted to the hot water tank 4.2. In the embodiment represented, the primary side of the heat exchanger 6 is also connected to the waste air line 12 in order to exploit the heat energy from the waste air present therein.

From the hot water tank 4.2, the hot water for the hot-water flushing following the respective internal cleaning of the keg is conducted via a pipe connection 16 to the treatment position 3.5. The return water incurred during the hot-water flushing is conducted, at a temperature perceptibly above the temperature T1, for example at a temperature of some 70° C., via a pipe connection 16.1 to the mixed water tank 4.1, from which the mixed water is conducted via a pipe connection 17 to the treatment position 3.2. The pipe 16.1 therefore forms the only infeed of the mixed water tank 4.1. The return water incurred at the treatment position 3.2 is conducted via a pipe connection 17.1 to the primary side of the heat exchanger 6, from which this return water, after adequate yield of its heat energy, is ejected via a discharge line 20 provided with a control valve 19. Preferably, at the treatment position 3.2, before the initiation of the pre-cleaning with the mixed water from the mixed water tank 4.1, a complete emptying of the keg interior of filling product residues takes place, which usually exhibit a temperature perceptibly below the temperature T1, and therefore are ejected directly via the primary side of the heat exchanger 6 and the opened discharge line 20.

A part of the mixed water heated to the temperature T1 is also conducted via a pipe connection 18 to a tank 21 of the treatment position 3.1, from which nozzles 22 are fed for the external cleaning of the keg by way of a pump 23.

As indicated, the heat exchanger 6 is designed as a cyclone heat exchanger, i.e. designed in such a way that the return water conducted via the pipe connection 17.1 is retained in the cyclone or cyclone chamber 6.1 forming the primary side of the heat exchanger, by the formation of a vortex, until an optimum or maximum possible heat transfer to the fresh water flowing through the secondary side of this heat exchanger 6 is attained, but also a separation of liquid and vapor and/or mists. Only then is the return water conducted away as waste water from the cyclone chamber 6.1 of the heat exchanger 6 by the opening of the control valve 19.

The primary side of the heat exchanger 7 in the embodiment represented is a constituent part of a mixed water circuit, of which the pipe connection is designated in FIG. 1 by 24, and which contains a circulating pump 25, which is connected with its inlet to the mixed water tank 4.1, and with its outlet connected to both the pipe connection 24 as well as to the pipe connection 17, such that the pump 25 serves on the one hand to deliver the mixed water to the treatment position 3.2 and, on the other, to return mixed water through the primary side of the heat exchanger 7 into the mixed water tank 4.1 and therefore to pre-heat the fresh water in this heat exchanger 7. In parallel with the connections of the secondary side of the heat exchanger 7, flowed through by the fresh water, a bypass 26 with a control valve 27 is also provided.

Although the waste water from the treatment position 3.5, conducted back via the line connection 16.1 to the mixed water tank 4.1, exhibits a temperature of over 70° C. for example, which is above the temperature T1, it is possible, by the pre-heating of the fresh water in the heat exchanger 7 and, respectively by the cooling thereby incurred of the mixed water in the heat exchanger 7, for the mixed water in the mixed water tank 4.1 to be kept at the lower temperature T1, and, specifically, without the necessity of admixture of fresh cold water to the mixed water.

The pre-heating of the fresh water in the heat exchanger 7 and, respectively, the cooling of the hot return water, conducted back to the mixed water tank 4.1 via the pipe connection 16.1, take place, for example, by controlling the volume flow of the mixed water through the heat exchanger 7 with the aid of the pump 25 or with the aid of a further control valve, not shown, and/or by controlling the volume flow of the fresh water through the heat exchanger 7, making use of the control valve 27 in the bypass 26. The latter also serves, for example, at the start of production, to allow rapid filling of the hot water tank 4.2, circumventing the heat exchanger 7 with fresh water, which is then, initially alone, heated in the heating device 9 and/or 10 to the temperature T2.

The heating device 10 or, respectively, the heat exchanger 10.1 forming this heating device, are constituent parts of a hot water circuit with the pipe connection 28, in which the secondary side of the heat exchanger 10.1 is arranged, as well as with a pump 29, the inlet of which is connected to the hot water tank 4.2 and the outlet of which is connected to the pipe connections 16 and 28, such that the pump 29 serves on the one hand to deliver the hot water to the treatment position 3.5, and, on the other, also serves as a circulating pump for drawing the hot water from the hot water tank 4.2 and for returning the hot water via the heat exchanger 10.1 into this tank, and therefore serves to maintain the temperature T2 for the hot water. The heating in the heat exchanger 10.1 is controlled by the volume flow of the hot heating medium flowing through the primary side, for example water vapor, and likewise the heating of the fresh water to the temperature T2 in the heat exchanger 9.1 is also controlled.

FIG. 3 shows, with the line I, the step-by-step heating of the cold fresh water, conducted to the connection 13 at the temperature T3, by waste heat recovery during running operation of the system 1, to the temperature T6, which is perceptibly above the temperature T1 and, for example, only slightly below the temperature T2. In the heating device 9, only further heating of the fresh water by the difference temperature is necessary in order to reach the temperature T2. The broken line II also represents the temperature curve of the fresh water without pre-heating by heat recovery. In this case, it is necessary for the fresh water alone to be heated in the heating device 9 from the temperature T3 to the temperature T2, which means a substantially higher energy requirement; i.e. with the arrangement according to the invention, the heat energy corresponding to the temperature difference $A_2T$ between the temperatures T3 and T6 is saved thanks to the heat recovery.

The invention has been described heretofore by way of an embodiment. It is understood that many modifications and derivations are possible, without thereby departing from the underlying concept of the invention.

By way of example, the principle has been adopted heretofore that, for the treatment of the kegs 2 and for the performance of the different treatment steps, a plurality of treatment positions 3.1-3.6 are provided for. The possibility of course pertains of a plurality of treatment steps being carried out at one or also at several treatment positions on the respective keg 2, in temporal sequence one after another, and specifically by corresponding controlling of the treatment media required for the individual treatment steps.

The principle has also been adopted heretofore that the heat exchanger 7 is arranged on the primary side in a circuit for the fresh water which includes the fresh water tank 4.1. Preferably however, the heat exchanger 7 is a tank-integrated heat exchanger of the tank 4.1, i.e. the heat exchanger 7 is arranged, for example, in the tank 1, and in this situation, for example in its embodiment as a tube nest unit, comprises as the tube nest heat exchanger or tube coil heat exchanger only the flow channel, which forms the secondary side through which the fresh water flows.

The invention claimed is:

1. A method for treating an interior of a keg using a keg treatment machine, said method comprising a first treatment-step and a second treatment-step, wherein said second treatment-step follows said first treatment step sequentially in time, wherein said heat-recovery step occurs during operation of said keg-treatment machine, wherein said first treatment-step occurs after said keg has been emptied of filling-product residue, wherein said first treatment-step comprises treating said interior with a first liquid treatment-medium, wherein said first liquid treatment-medium comprises mixed water at a first temperature, wherein said second treatment-step comprises treating said interior of said keg with a second treatment-medium, wherein said second treatment-medium comprises water at a second temperature, wherein said second temperature is higher than said first temperature, wherein said method further comprises exclusively using, in said second treatment-step, heat energy that has been recovered from first treatment-medium that has been used in said first treatment-step, and/or using heat energy that has been recovered from first treatment-medium that has been used in said first treatment-step to carry out pre-heating of treatment-medium conducted to a first tank, and/or by heat energy recovered from waste air that has been used during said first treatment-step.

2. The method of claim 1, wherein using heat energy that has been recovered from first treatment-medium that has been used in said first treatment-step to carry out pre-heating of treatment-medium conducted to a first tank and/or by heat energy recovered from waste air that has been used during said first treatment-step comprises passing said treatment-medium through a cyclone heat-exchanger of a first heat-exchanger, said cyclone heat-exchanger comprising a cyclone chamber, and passing said first treatment-medium that has been used in said first treatment-step through said cyclone heat-exchanger thereby forming a cyclone-type flow for heat transfer prior to being conducted out of said cyclone chamber.

3. The method of claim 1, further comprising externally cleaning said keg wherein using heat energy that has been recovered from first treatment-medium that has been used in said first treatment-step to carry out pre-heating of treatment-medium conducted to a first tank and/or by heat energy recovered from waste air that has been used during said first treatment-step comprises recovering heat from waste air, and heating said treatment medium with said recovered heat.

4. The method of claim 1, wherein using heat energy that has been recovered from first treatment-medium that has been used in said first treatment-step to carry out pre-heating of treatment-medium conducted to a first tank and/or by heat energy recovered from waste air that has been used during said first treatment-step comprises recovering heat from waste air from a tank containing a treatment medium.

5. The method of claim 1, further comprising using a heating device to heat treatment-medium from a third temperature to said second temperature.

6. The method of claim 2, further comprising passing said treatment-medium to a secondary side of a second heat-exchanger for heating by first treatment-medium from said first tank.

7. The method of claim 2, wherein-using heat energy that has been recovered from first treatment-medium that has been used in said first treatment-step to carry out pre-heating of treatment-medium conducted to a first tank and/or by heat energy recovered from waste air that has been used during said first treatment-step comprises recovering heat from waste air, wherein said waste air is from said cyclone heat-exchanger.

8. The method of claim 6, wherein using heat energy that has been recovered from first treatment-medium that has been used in said first treatment-step to carry out pre-heating of treatment-medium conducted to a first tank and/or by heat energy recovered from waste air that has been used during said first treatment-step comprises passing treatment medium from said second heat-exchanger through a third heat-exchanger, and passing waste air through said third heat-exchanger.

* * * * *